US008439998B2

(12) United States Patent
Ito et al.

(10) Patent No.: US 8,439,998 B2
(45) Date of Patent: May 14, 2013

(54) MANUFACTURING METHOD OF METAL PRODUCT AND METAL PRODUCT

(75) Inventors: Kenzo Ito, Tokyo (JP); Masahiro Yamamoto, Shizuoka (JP); Etsuo Yamamoto, Shizuoka (JP)

(73) Assignees: Sunrex Kogyo Co., Ltd., Tokyo (JP); Nanopulus Co., Ltd., Hamamatsu (JP); Ace Giken Co., Ltd., Hamamatsu (JP)

( * ) Notice: Subject to any disclaimer, the term of this patent is extended or adjusted under 35 U.S.C. 154(b) by 634 days.

(21) Appl. No.: 11/791,231

(22) PCT Filed: Dec. 2, 2005

(86) PCT No.: PCT/JP2005/022179

§ 371 (c)(1),
(2), (4) Date: Nov. 16, 2007

(87) PCT Pub. No.: WO2006/062039

PCT Pub. Date: Jun. 15, 2006

(65) Prior Publication Data

US 2008/0241568 A1 Oct. 2, 2008

(30) Foreign Application Priority Data

Dec. 6, 2004 (JP) ..... 2004-353287

(51) Int. Cl.
*B22F 9/20* (2006.01)

(52) U.S. Cl.
USPC ..... 75/255; 148/301; 148/302

(58) Field of Classification Search ..... 148/301, 148/302; 75/255
See application file for complete search history.

(56) References Cited

U.S. PATENT DOCUMENTS

| | | | | |
|---|---|---|---|---|
| 5,724,758 | A | 3/1998 | Gulick | |
| 6,467,277 | B2 * | 10/2002 | Okamura et al. | 62/6 |
| 7,622,010 | B2 * | 11/2009 | Kuniyoshi et al. | 148/301 |
| 2004/0077958 | A1 | 4/2004 | Kato et al. | |
| 2004/0263969 | A1 | 12/2004 | Lipton et al. | |
| 2005/0006005 | A1 | 1/2005 | Kuniyoshi et al. | |
| 2005/0182201 | A1 | 8/2005 | Matsumoto et al. | |
| 2005/0192501 | A1 | 9/2005 | Sano et al. | |

FOREIGN PATENT DOCUMENTS

| | | |
|---|---|---|
| JP | 2002-294308 | 10/2002 |
| JP | 2003-166001 A | 6/2003 |
| JP | 2004-277877 | 10/2004 |
| WO | WO 03/045611 A1 | 6/2003 |

OTHER PUBLICATIONS

Japanese Abstract in English for JP2003-166001.
Japanese Abstract in English for JP2004-277877.

* cited by examiner

*Primary Examiner* — Scott Kastler
(74) *Attorney, Agent, or Firm* — Oliff & Berridge, PLC

(57) ABSTRACT

In sintering a metal powder after pressure molding into a given configuration, random amorphous flaky metal fine powders (10) are used as metal powder materials. In addition, spherical particulate metal powders 11 are used as main materials, and random amorphous flaky metal fine powders 10 having finer particle size than the metal powders 11 and produced by fracturing a metal fracture material by means of high-velocity gas swirling flow are used as sub-materials, and molding and sintering are performed in a state of dispersing the sub-materials (10) in the main materials (11). Thus, despite being a power metallurgical product, it is possible to obtain a metal product having a dense metallographic structure and excellent in properties such as mechanical strength.

2 Claims, 5 Drawing Sheets

MANUFACTURING METHOD OF METAL PRODUCT AND METAL PRODUCT

TECHNICAL FIELD

The present invention relates to a manufacturing method of a metal product obtained by molding and sintering a metal powder into a given configuration and the metal product.

BACKGROUND ART

As a method of manufacturing the metal product of a given configuration, the method of casting, forging, rolling, and machining, etc are given as examples. However, a powder metallurgy process is frequently used, in which a metal powder (powder) is used as a metal material, and a powder compact is obtained by press-molding this metal powder and thereafter this powder compact is heated and sintered, for the metal product having a precise and complicated shape or the metal product requiring a particular material characteristic like a magnetic component.

In this powder metallurgy, the metal powder with a particle size of 1 μm to 100 μm manufactured by an atomizing method is mainly used (see patent document 1). The metal powder manufactured by the atomizing method has a powder particle with an approximately spherical particle shape. However, this spherical-shaped powder has a high flowability, with little friction between powder particles, and this is suitable for press-molding by charging into a metal mold. Therefore, in the powder metallurgy, the spherical-shaped powder is mainly used.

FIG. 5 schematically shows a manufacturing step of the metal product by a conventional powder metallurgy. As shown in this figure, a spherical-shaped metal powder 11 manufactured by an atomizing method is used in a sintering material. This metal powder 11 is molded/solidified into a given configuration by press-molding using the metal mold (compacting molding).

Usually a binder (bond) is used for molding. The binder is previously mixed in the metal powder. Alternately, a spherical-shaped granule (cluster sphere) of a prescribed size is granulated by the metal powder and the binder, and this granulated material is press-molded into a given configuration.

A molded powder compact (molded/solidified product) 31 is subjected to sintering processing at a high temperature after passing through a drying step, etc. By this sintering, the powder particles are partially fusion (diffusion)-bonded to be integrated, and a metal product 32, with the configuration solidified finally, is obtained.

Patent document 1: Japanese Patent Laid Open No. 2002-294308

DISCLOSURE OF THE INVENTION

Problem to be Solved by the Invention

However, it is clarified by the inventors of the present invention that the above-described conventional art involves problems as will be described below.

Namely, the spherical-shaped metal powder obtained by an atomizing method has a large air gap rate of the press-molded powder compact, and there is a limitation in densification. Therefore, it is difficult to obtain the metal product requiring a high degree of mechanical strength or the metal product requiring a dense metallographic structure in a material.

In addition, the spherical-shaped metal powder having high flowability has a problem that a shape-keeping strength for press-molding (powder compact molding) into a given configuration is deteriorated, thus easily generating cutout or crack by an impact or the like. Therefore, in order to improve the shape-keeping strength of the powder compact, a large quantity of binder needs to be used. However, when a use amount of the binder is increased, there involves a problem that an internal air gap which is left after sintering is increased.

In the press-molded powder compact, the powder particle is fusion-bonded, solidified, and integrated by sintering. However, this sintered material has a granular metallographic structure in which the powder particle is condensed in a state of approximately holding each particle shape. This granular metallographic structure is specific to a powder metallurgy, but involves a problem that such a metallographic structure is brittle, because of deteriorated mechanical strength, particularly impact resistance. Therefore, in many cases, the metal product requiring a high degree of mechanical strength is manufactured by a method other than the powder metallurgy such as forging, rolling, and machining.

In many cases, the metal product requires a material of an amorphous metallographic structure or a continuous dense metallographic structure without fine air gaps. The powder metallurgy of the granular structure can not be adapted to this requirement. In the powder metallurgy, the air gaps between the granular structures can be reduced if the sintering is performed at a sufficiently high temperature for a sufficient time. However, in this case, there is a problem that a sintering processing at a high temperature for a long time is required.

In addition, even if a sintering condition is changed, the densification of the powder compact using the spherical powder has a limitation, and is not suitable for the metal product requiring a high degree of mechanical strength or a dense metallographic structure. Even if the sintering processing is performed at a high temperature for a long time, there is a problem that the vicinity of a surface, a corner part, and a projection part are contracted or melted to deteriorate shape accuracy.

In view of the above-described problems, the present invention is provided, and an object of the present invention is to realize the high densification of the metallographic structure, which is difficult to be realized by a conventional powder metallurgy, thereby making it possible to manufacture by the powder metallurgy the metal product provided with a high degree of mechanical strength, particularly a high impact-resistance property, and in addition, to provide the metal product having a fine metallographic structure and excellent in a mechanical strength, despite being a powder metallurgy product.

The object and structure other than the aforementioned ones will be apparent by description of this specification and the appended views.

Means for Solving the Problems

The present invention provides the following solving means.

(1) A manufacturing method of a metal product, comprising: pressure-molding a metal powder into a given configuration, and thereafter fusion-bonding the air gap between powder particles of a molded material by sintering, wherein a random amorphous flaky metal fine powder produced by fracturing a metal fracture material by means of high-velocity gas swirling flow of jet mill is used as the aforementioned metal powder material.

(2) The manufacturing method of the metal product according to (1), comprising: performing granulation to collect the random amorphous flaky metal fine powder produced by fracturing the metal fracture material by means of high-velocity gas swirling flow of jet mill into a size of a prescribed largeness; molding this granulated material into a given configuration by a molding die; and thereafter sintering the molded material thus obtained.

(3) The manufacturing method of the metal product, which is manufactured by the manufacturing method of either of the aforementioned (1) or (2).

(4) A metal product, wherein spherical particulate metal powders are used as main materials, and random amorphous flaky metal fine powders having a finer particle size than the metal powders and produced by fracturing the metal fracture material by means of high-velocity gas swirling flow are used as sub-materials, and molding and sintering are performed in a state of dispersing the sub-materials in the main materials.

(5) The metal product, wherein in the aforementioned means (4), the powder particles of the main materials are sintered in a state that the powder particles of the main materials are brought into contact with each other, and are sintered in a state that the powder particles of the sub-materials are charged in the air gap between the powder particles of the main materials.

Advantage of the Invention

According to the aforementioned means (1), the air gap rate of the press-molded powder compact can be made small. This is because of using powder material of a unique configuration and condition produced by fracturing the metal fracture material by means of high-velocity gas swirling flow of jet mill, namely, the random amorphous flaky metal fine powder. In addition, even if the use amount of the binder is little, or even if not using the binder, the shape-keeping strength of the powder compact can be secured.

Thus, it is possible to realize the high densification of the metallographic structure, which is difficult to be realized in the conventional powder metallurgy, and for example, the metal product having high mechanical strength, particularly high impact resistance property can also be manufactured by the powder metallurgy.

According to the aforementioned means (2), in addition to the above-described advantage, homogeneity of the metallographic structure can be significantly improved.

According to the aforementioned means (3), despite being the powder metallurgical product, the metal product with fine metallographic structure and excellent in properties such as mechanical strength can be provided.

According to the aforementioned means (4), the amorphous flaky metal fine powders, which are mixed/dispersed as the sub-materials, are deformed or shaped so as to fill the air gap between particles of the spherical particulate metal powders, being the main materials. Therefore, the press-molded powder compact can obtain a high shape keeping strength, thereby hardly generating a break and a crack even if a little use amount of the binder or not using the binder.

According to the aforementioned (5), the spherical particulate metal powder forms a framework structure in a three-dimensional network (or lattices), and the metallographic structure, with the amorphous flaky metal fine powder filled in the air gap of this framework structure is formed. Thus, the metal product having the advantage of the powder metallurgy such as high rigidity and the impact resistance which is not obtained by the conventional powder metallurgy can be obtained. In addition, a sintered metal product with fine metallographic structure which is not obtained by the conventional powder metallurgy can be obtained.

Action/advantage other than the aforementioned ones of the present invention will be apparent from the description of this specification and the appended drawings.

BEST MODES FOR CARRYING OUT THE INVENTION

Preferred embodiments of the present invention will be explained with reference to the drawings hereunder.

Embodiment 1

FIG. 1 is a view schematically showing the step of a manufacturing method of a metal product according to a first embodiment of the present invention. The present invention provides the manufacturing method of the metal product in which the metal powder is pressure-molded into a given configuration, and thereafter the air gap between the powder particles of the molded material is fusion-bonded by sintering, and the metal product. The metal powder used here has properties as will be described below.

Namely, as shown in this figure, in the first embodiment of the present invention, a metal fine powder 10 fractured by a jet mill is used as the metal powder, being the molded material. The jet mill performs fracture of a metal fracture material by an impact of fracture materials by means of high velocity gas swirling flow.

By this fracture, for example as schematically and expandedly shown in this figure, an amorphous flaky metal fine powder 10 with random configuration is generated. The powder particle configuration is non-spherical and random, and therefore this metal fine powder 10 can not be defined with the same scale as the conventional spherical particulate powder. However, the metal fine particle 10 is fractured in a fine particle state corresponding to about 0.1 μm to several dozen μm.

The aforementioned metal fine powder 10 is molded into the powder compact (molded/solidified product) 21 of a given configuration by a press molding (pressure molding) by using a die. In molding this powder compact, the metal fine powder 10 is molded into a given configuration, while the amorphous flaky particle shape is freely deformed by pressure molding so as to fill the air gap between the powder particles.

Thus, the air gap rate between the powder particles can be made small. Further, the powder particles are folded and overlapped in a complicate manner, or molded and solidified in an intertwined state. Therefore, even if a little use amount of a binder or not using the binder, a shape keeping strength after molding is improved and the powder compact 21 that hardly allows the break and crack to be generated can be obtained.

The powder compact 21 is firmly integrated by fusion-bonding the air gap between the powder particles by sintering. However, in this case also, the powder particle complicately folded/overlapped or intertwined is sintered in a dense metallographic structure.

In addition, compared to a case of using the conventional spherical particulate powder, it is found that a sintering temperature can be set to a significantly low temperature, thereby obtaining a metal product 22 sintered with high density and high strength. This is an unexpected case, but it is so estimated that an increased surface rate due to the amorphous flaky shape of the powder particle makes it easy to generate melting and bonding. In any case, this makes it possible to perform a necessary sintering process at a lower sintering temperature than conventional at a low cost.

As described above, it is possible to realize the high densification of the metallographic structure which is difficult to be realized by the conventional powder metallurgy, thus making it possible to manufacture the metal product provided with high mechanical strength, particularly high impact resistance, for example, by the powder metallurgy. In addition, despite being the powder metallurgical product, it is possible to provide the metal product having a dense metallographic structure and small air gap rate.

Further, according to the present invention, it is possible to perform granulating to collect the amorphous flaky metal fine powders 10 into a largeness of prescribed size, and after molding this granulated matter into a given configuration by a molding die, sinter this molded material and obtain the same effect as described above. Namely, a granulating process may be included in the step of molding the powder compact. In this case, in addition to the above-described effect, uniformity of the metallographic structure can be significantly improved.

Embodiment 2

FIG. 2 is a rough step view schematically showing the manufacturing method of the metal product by the second embodiment. In this second embodiment, a spherical particulate metal powders 11 obtained by an atomizing method are used as main materials, and a random amorphous flaky metal fine powders 10 having a finer particle size than the metal powders 11 and produced by fracturing the metal fracture material by means of high-velocity gas swirling flow are used as sub-materials, and molding and sintering are performed in a state of dispersing the sub-materials (10) in the main materials (11).

In the step shown in this figure, the sub-materials consisting of the amorphous flaky metal powders 10 are mixed and dispersed in the main materials consisting of the spherical particulate metal powders 11 at a prescribed ratio, and a mixture material thus obtained is molded into the powder compact 21 of a given configuration by press-molding (pressure molding) using a die.

At this time, by deforming and shaping the press-molded powder compact 21, so that the amorphous flaky metal fine powders 10 mixed/dispersed as the sub-materials fill the air gap between the particles of the spherical particulate metal powders 11, being the main materials, in the same way as described above, even if a little use amount of the binder, or not using the binder, the high shape-keeping strength hardly generating a break and a crack can be obtained.

When the aforementioned powder compact 21 is sintered, it is possible to obtain the metal product 22 whose configuration is firmly fixed by fusion-bonding the air gap between the powder particles. As is shown in an expanded model of the metallographic structure in FIG. 3, the spherical particulate metal powder 11 with large particle form constitutes a framework structure of a three-dimensional network shape (or lattices), and has the metallographic structure in which the amorphous flaky metal fine powder 10 is filled in the air gap of this framework structure.

Thus, it is possible to obtain the metal product of high strength having not only an advantage of the powder metallurgy such as high rigidity, but also the impact resistance which is not obtained by the conventional powder metallurgy. In addition, it is possible to obtain a sintered metal product of a dense metallographic structure which can not be obtained by the conventional powder metallurgy.

A mixing ratio of the aforementioned main materials 11 and the aforementioned sub-materials 10 may be set theoretically, so that an amount corresponding to the air gap generated at the time of molding/sintering only by the main materials 11 is occupied by the sub-materials 10. If the sub-materials are excessively mixed-in, the powder particles of the main materials are not brought into contact and bonded with each other, and dispersed and released into the sub-materials. Accordingly, the mixing ratio of the sub-materials to the main materials must not exceed at least 50%. Meanwhile, if the mixture of the sub-materials is excessively low, the air gap rate between the powder particles of the main materials becomes large. Accordingly, the sub-materials need to be mixed-in (or added), so that the air gap of the metallographic structure is significantly reduced.

As described above, the present invention has been explained based on its typical examples. However, the present invention can be variously modified other than the aforementioned examples. For example, FIG. 4(*a*) to FIG. 4(*k*) exemplify the shape of the metal product 22 that can be provided by the present invention. However, the present invention can be effectively applied to the metal product requiring a particular material property in addition to a shape accuracy and mechanical strength property, like a magnetic component, for example.

INDUSTRIAL APPLICABILITY

According to the present invention, it is possible to realize the high densification which is difficult to be realized in the conventional powder metallurgy, thereby making it possible to manufacture the metal product provided with the high mechanical strength particularly high impact resistance. Also, despite being the power metallurgical product, it is possible to provide the metal product having a dense metallographic structure and excellent in properties such as mechanical strength.

DESCRIPTION OF THE SIGNS AND NUMERALS

Figure 1:
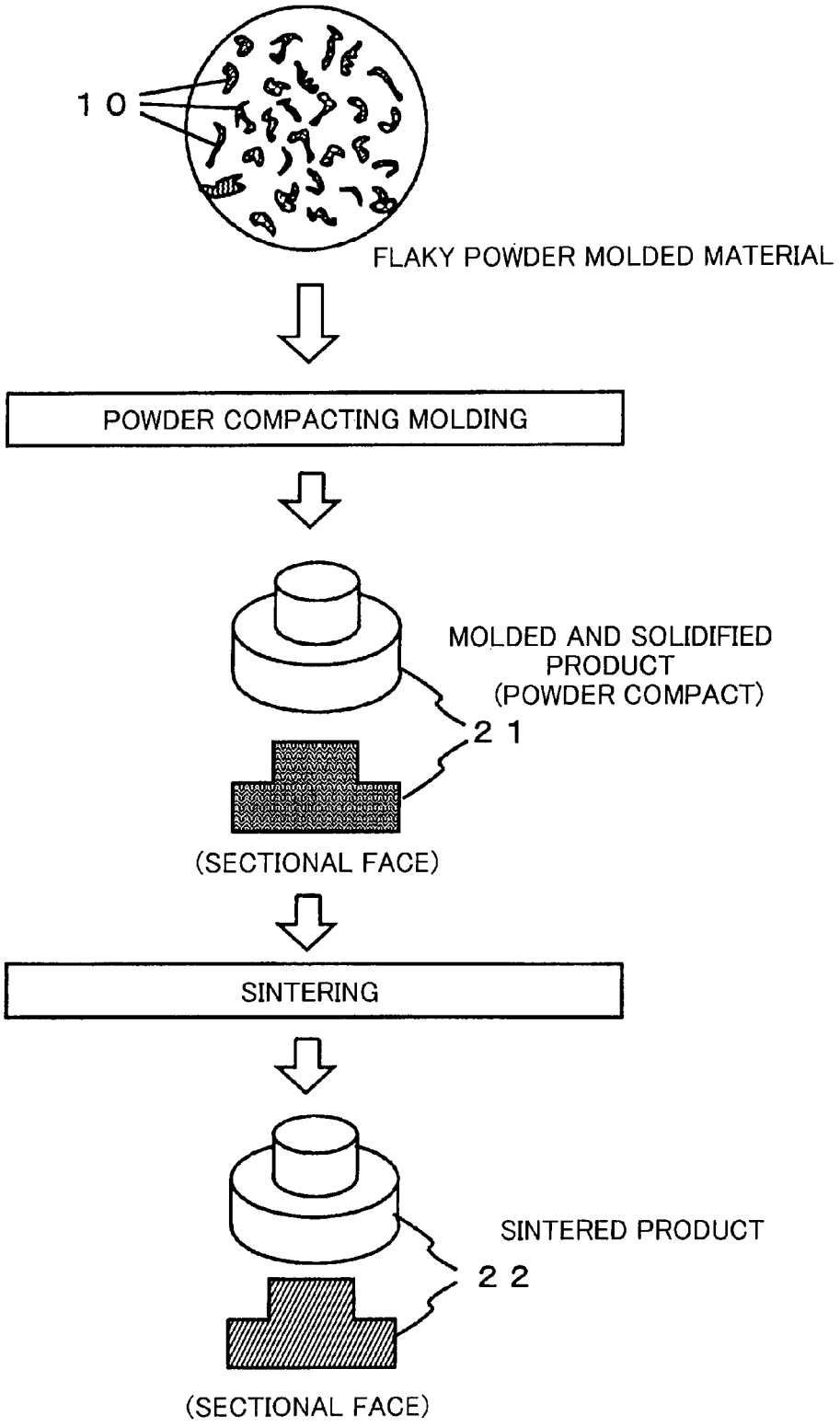
FIG. 1 is a rough step view schematically showing a manufacturing method of a metal product according to a first embodiment of the present invention.
Figure 2:
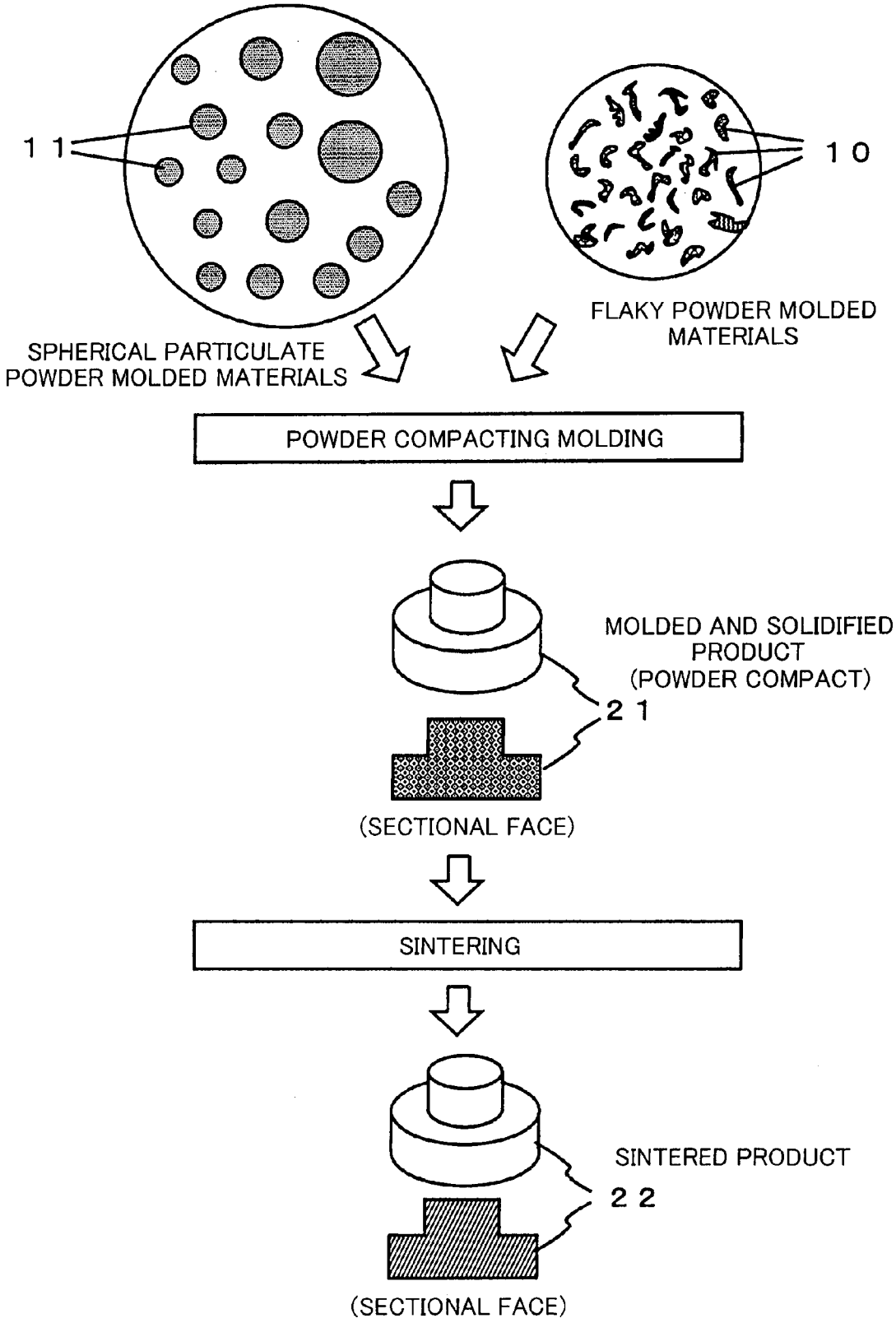
FIG. 2 is a rough step view schematically showing the manufacturing method of the metal product according to a second embodiment of the present invention.
Figure 3:
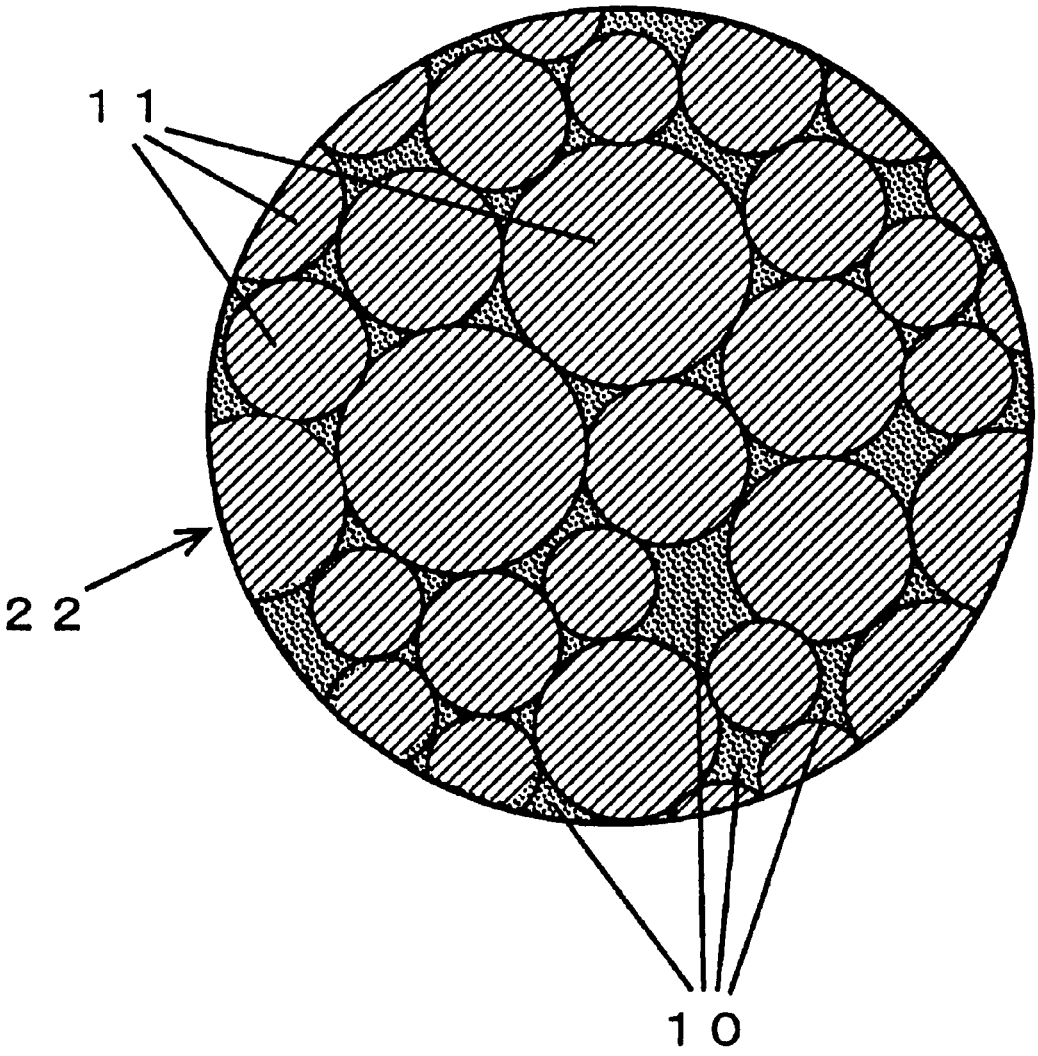
FIG. 3 is an expanded model view showing a metallographic structure of the metal product obtained by the second embodiment of the present invention.
Figure 4:
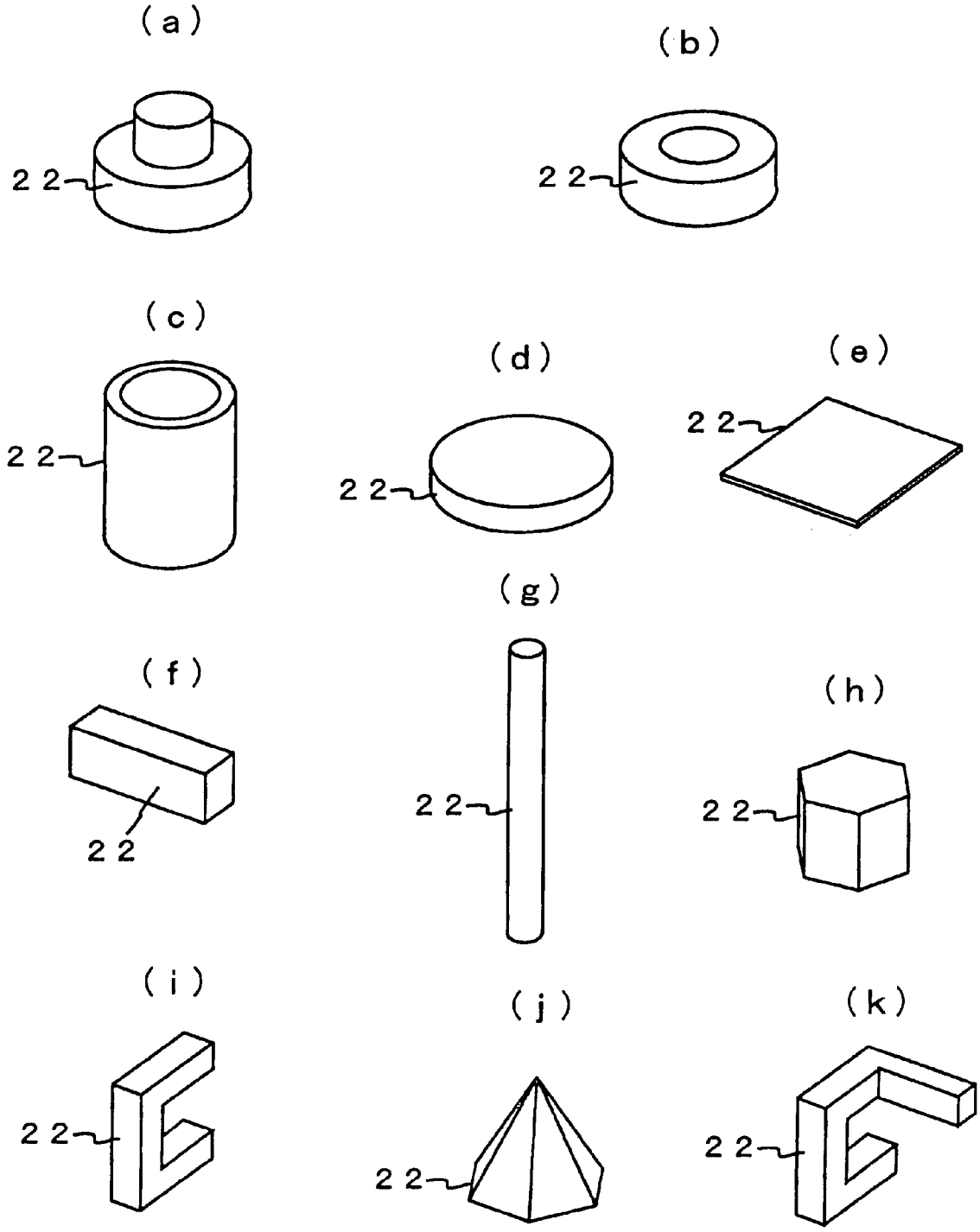
FIG. 4 is a perspective view showing a shape example of the metal product that can be provided by the present invention.
Figure 5:
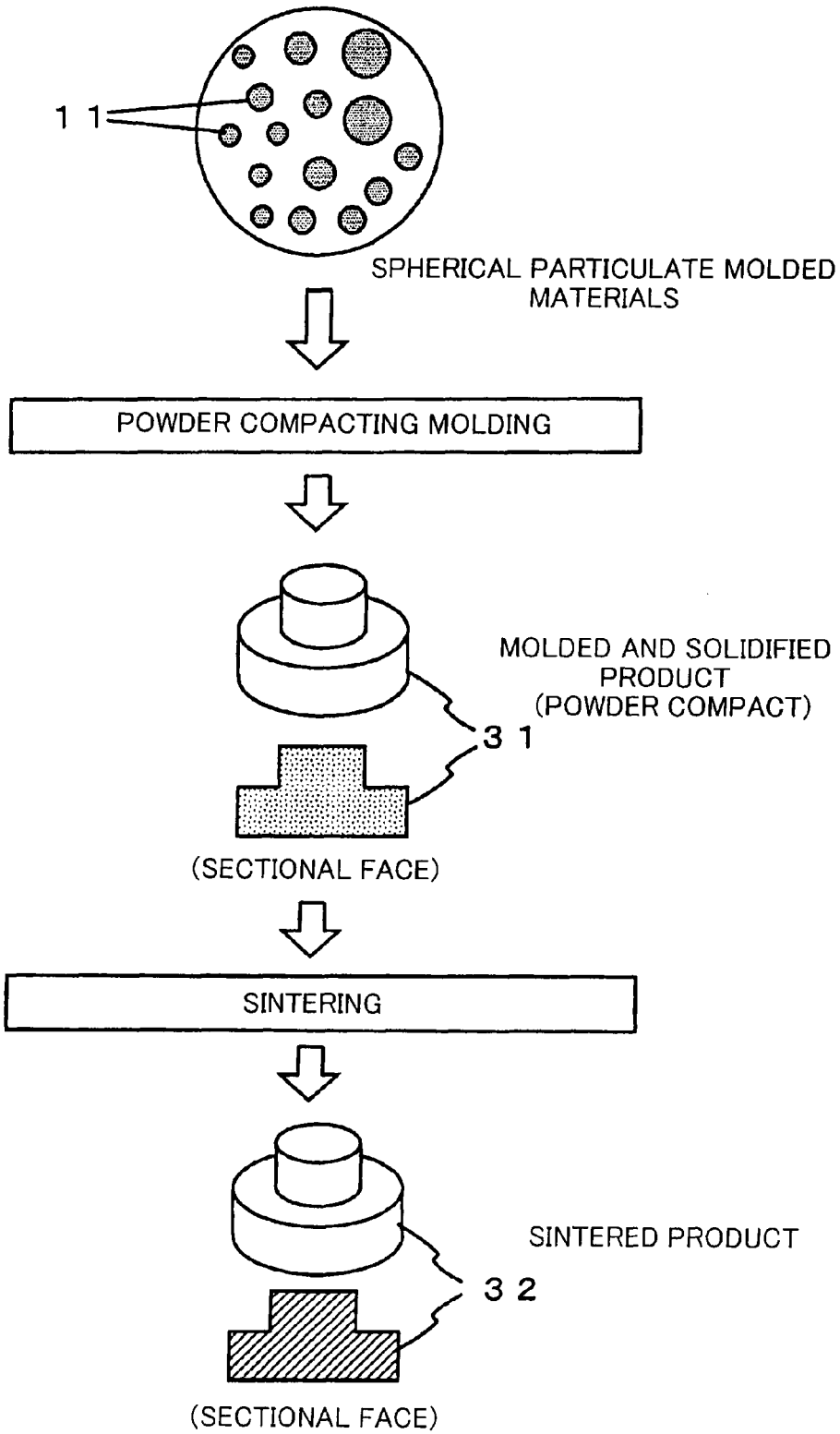
FIG. 5 is a rough step view schematically showing the manufacturing step of the metal product by a conventional powder metallurgy.

10 Amorphous flaky metal powder
11 Spherical particulate metal powder
21, 31 Powder compact (molded/solidified product)
22, 32 Metal product (sintered material)

The invention claimed is:

1. A method of manufacturing a metal product obtained by pressure-molding metal powders into a given configuration, and thereafter fusion-bonding particles of this molded metal powders together by sintering, comprising steps of:

producing spherical particulate metal powders, producing random flaky metal fine powders having a smaller particle size than the spherical particulate metal powders by fracturing a metal fracture material by means of high-velocity gas swirling flow of jet mill, producing a mixture material by dispersing the flaky metal fine powders as a sub-material in spaces among the spherical particulate metal powders as a main material, so that a mixing ratio of the sub-material to the main material does not exceed 50%, pressure-molding the mixture material using a metal mold, wherein the spherical particulate metal powders retain a spherical shape, and sintering the press-molded mixture material so that a framework structure having a three-dimensional network or a lattice shape is formed by fusion-bonding particles of the spherical particulate metal powders together, and air gaps in the framework structure are filled up with the random flaky metal fine powders.

2. A metal product, manufactured by sintering and fusion-bonding spherical articulate metal powders and random flaky metal fine powders having a smaller particle size than the spherical particulate metal powders, wherein the spherical particulate metal are a main material, the flaky metal fine powders are a sub-material, a mixing ratio of the sub-material to the main material does not exceed 50%, a framework structure having a three-dimensional network or a lattice shape is formed by fusion-bonding particles of the spherical particulate metal powders together, air gaps in the framework structure are filled up with the flaky metal fine powders, and the spherical particulate metal powders in the framework structure retain a spherical shape.

* * * * *